US010328474B2

(12) United States Patent
Pelissero

(10) Patent No.: US 10,328,474 B2
(45) Date of Patent: Jun. 25, 2019

(54) COMBINED DEVICE FOR BENDING AND CUTTING RIBBON-SHAPED ELEMENTS AND METHOD FOR BENDING AND CUTTING RIBBON-SHAPED ELEMENTS THROUGH SUCH DEVICE

(71) Applicant: BYTE LINE DI PELISSERO ALESSANDRO, Treviglio (IT)

(72) Inventor: Alessandro Pelissero, Treviglio (IT)

(73) Assignee: BYTE LINE DI PELISSERO ALESSANDRO, Treviglio (BG) (IT)

( * ) Notice: Subject to any disclaimer, the term of this patent is extended or adjusted under 35 U.S.C. 154(b) by 66 days.

(21) Appl. No.: 15/518,979

(22) PCT Filed: Oct. 23, 2014

(86) PCT No.: PCT/IT2014/000276

§ 371 (c)(1),
(2) Date: Apr. 13, 2017

(87) PCT Pub. No.: WO2016/063306

PCT Pub. Date: Apr. 28, 2016

(65) Prior Publication Data

US 2017/0239702 A1 Aug. 24, 2017

(51) Int. Cl.

| | |
|---|---|
| ***B21D 5/04*** | (2006.01) |
| ***B21D 43/28*** | (2006.01) |
| ***B21D 28/00*** | (2006.01) |

(52) U.S. Cl.

CPC ..... *B21D 5/042* (2013.01); *B21D 28/00* (2013.01); *B21D 43/287* (2013.01)

(58) Field of Classification Search

CPC ..... B21D 5/042; B21D 5/045; B21D 43/287
See application file for complete search history.

(56) References Cited

U.S. PATENT DOCUMENTS

| | | | | |
|---|---|---|---|---|
| 5,099,671 A | | 3/1992 | Beaulac | |
| 5,461,893 A | * | 10/1995 | Tyler | B21D 5/042 72/10.1 |
| 5,787,750 A | | 8/1998 | Song | |

FOREIGN PATENT DOCUMENTS

| | | | |
|---|---|---|---|
| EP | 1264648 | A1 | 12/2002 |
| WO | 2007102176 | A1 | 9/2007 |

OTHER PUBLICATIONS

International Search Report dated Jun. 22, 2015 from European Patent Office.

* cited by examiner

*Primary Examiner* — Debra M Sullivan
(74) *Attorney, Agent, or Firm* — Dilworth & Barrese, LLP

(57) ABSTRACT

A combined device for bending and cutting ribbon-shaped elements is described, comprising first guiding and supporting means (1, 101) adapted to allow positioning a ribbon-shaped element (T, T1), second guiding and supporting means (3, 103) adapted to prevent the rotation of the ribbon-shaped element (T, T1) with respect to an axis belonging to a plane on which the ribbon-shaped element (T, T1) rests, first translating means (41, 1041) and rotation means (4, 104) adapted to move a tool (5, 105) with respect to the second guiding and supporting means (3, 103); the second guiding and supporting means (3, 103) comprise a portion of bending profile (8, 108) adapted to bend the ribbon-shaped element (T, T1) and a portion of cutting profile (9, 109) adapted to cut the ribbon-shaped element (T, T1). A method is further described for bending and cutting ribbon-shaped elements performed through such device.

8 Claims, 8 Drawing Sheets

COMBINED DEVICE FOR BENDING AND CUTTING RIBBON-SHAPED ELEMENTS AND METHOD FOR BENDING AND CUTTING RIBBON-SHAPED ELEMENTS THROUGH SUCH DEVICE

BACKGROUND OF THE INVENTION

1) Field of the Invention

The present invention refers to a combined device for bending and cutting ribbon-shaped elements.

In particular, the invention deals with a combined device for bending and cutting parts of dinking dies used in the paper sector starting from a ribbon-shaped element, typically made of metal, to obtain a profile.

2) Background Art

A completely manual process for making such profile first of all allows cutting a piece of ribbon, for a length corresponding to the development of the profile which has to be obtained, then bending it.

The same process can be performed by means of machines comprising a series of working stations, the main ones of which are the cutting and bending stations, and a dragging apparatus to move the ribbon therethrough.

Currently, the art substantially provides for two approaches to the performance of such actions.

A first method consists in completely cutting a piece of ribbon before bending it. Since such piece is completely cut, the passage through the bending station occurs by means of a guide along which such piece is pushed or by another piece cut afterwards or by the ribbon itself still to be cut, or also by a tool with a section similar to the ribbon's one. An example embodiment of such first method is disclosed in U.S. Pat. No. 5,787,750.

A second method consists in partially cutting, even not cutting at all, the piece to be made to be able to push such piece, still connected to the ribbon, into a bending station, and afterwards into a second cutting station adapted to definitively separate such piece from the ribbon. An example embodiment of such second method is disclosed in EP1264648.

As regards the bending station, a typical solution is disclosed in U.S. Pat. No. 4,627,255, which describes a bending machine, in which a metallic ribbon is bent during a sequence of longitudinal advancement steps of the ribbon alternated to flexure of the ribbon through a mobile tool which engages and deflects the ribbon when this later one is prevented from moving longitudinally. Such document then discloses feedback techniques to check the bending angle.

Such two method disclosed in U.S. Pat. No. 5,787,750 and EP1264648 allow making products with different features, such as bending angles, speed, guide, dummy pieces and costs.

Bending angles. The final cut of a piece performed after its bending often requires the widening of the bending angles, even over the actual mechanical limits of the bending station. In fact, the bent profile of the end of a ribbon could interfere with the device for the final cut. The problem is usually solved by limiting the opening of one or more angles in the bending step.

Speed. The final cut of the already bent end of a ribbon normally occurs in a more advanced position with respect to the bending station. This due to reasons linked to the sizes of the bending station and of the final cut. This often implies that, when creating pieces in a sequence, for some bending works on the following piece, the ribbon must be pushed back. These alternate front and back movements, which slows the execution, are not necessary for sequences of pieces of ribbon completely cut before their bending.

Guide and reference points. Handling of a completely cut piece of ribbon needs an efficient guide. Instead, for the end of a ribbon, it is enough to insert some mechanical bearing along the path. This is particularly advantageous when working rotary ribbons with a different diameter.

Dummy pieces. Completely cut pieces of ribbon having ends with profiles which cannot be paired for the thrust that cannot be put in a column. The problem is solved by cutting small dummy pieces which can guarantee the thrust. Instead, working the end of a ribbon does not need dummy pieces to guarantee the thrust.

Costs. Working of a completely cut piece of ribbon occurs with at least two stations, an initial cutting and a final bending station. Working of an end of a ribbon occurs with to least three stations, usually one for the initial partial cutting, one for bending and one for the final cutting. Under the same other conditions, the second method in general is much more costly that the first one.

A way to exploit and optimize the features of both these approaches consists in concentrating in the same station such bending and cutting actions. The current art already allows detaching a piece of ribbon by using the bending station, employing different alternate bending actions in order to be able to yield the material by acting on the same spot of the ribbon. But the biggest defect of this technique is given by the scarce quality obtained along such detachment line. Another problem of this technique depends on the slowness introduced by alternate bending movements.

SUMMARY OF THE INVENTION

Object of the present invention is providing a device capable of bending and cutting a ribbon-shaped element.

Another object is providing a device with limited needs of recurring to guides, capable of making bends next to the end and of not needing dummy pieces.

A further object is providing a device which does not need to widen the bends in order to make cutting tools pass therethrough and which is not slowed down by front-back ribbon movements.

A further object is providing a device with the bending and cutting actions in a combined way, which is compact and produced with reduced costs.

The above and other objects and advantages of the invention, as will appear from the following description, are obtained by a combined device for bending and cutting ribbon-shaped elements, as claimed in claim 1.

Moreover, the above and other objects and advantages of the invention, as will appear from the following description, are obtained by a combined method for bending and cutting ribbon-shaped elements, as claimed herein.

Preferred embodiments and non-trivial variations of the present invention are the subject matter of the dependent claims.

It is intended that all enclosed claims form an integral part of the present description.

It will be immediately obvious that numerous variations and modifications (for example related to shape, sizes, arrangements and parts with equivalent functionality) could be made to what is described, without departing from the scope of the invention as appears from the enclosed claims.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF THE PREFERRED EMBODIMENTS

Figure 1:
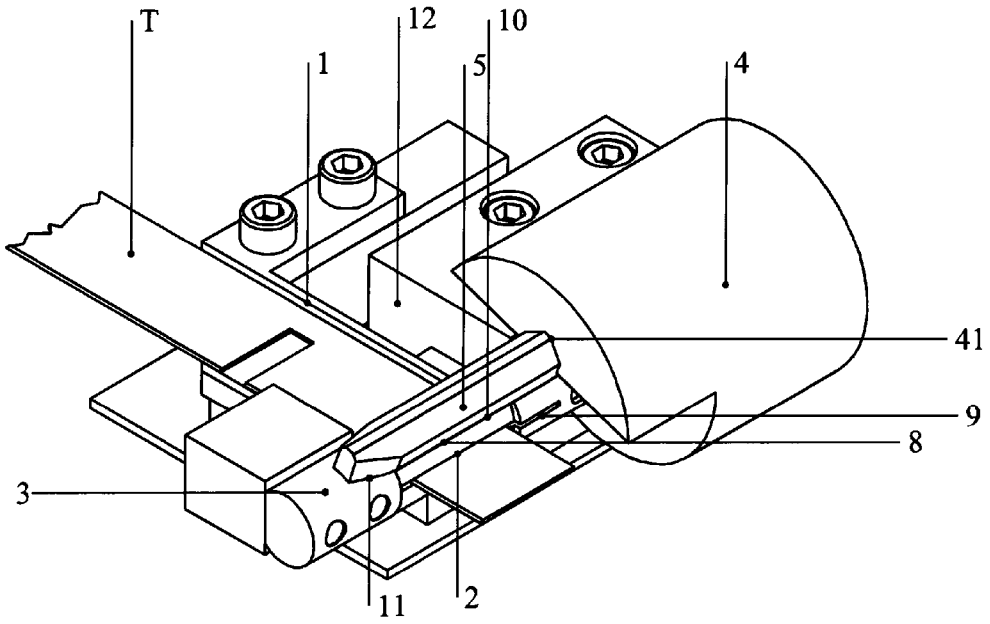
FIGS. 1 and 2 show an axonometric view of an embodiment of the device according to the present invention.
Figure 2:
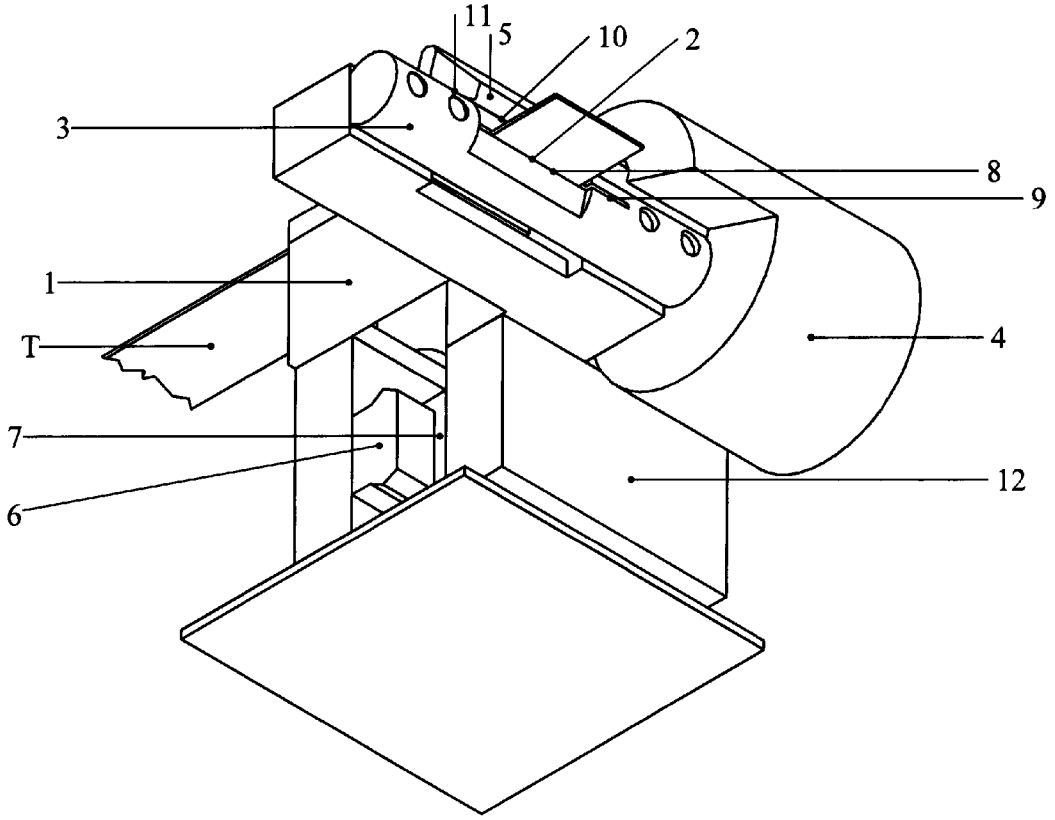
Figure 3:
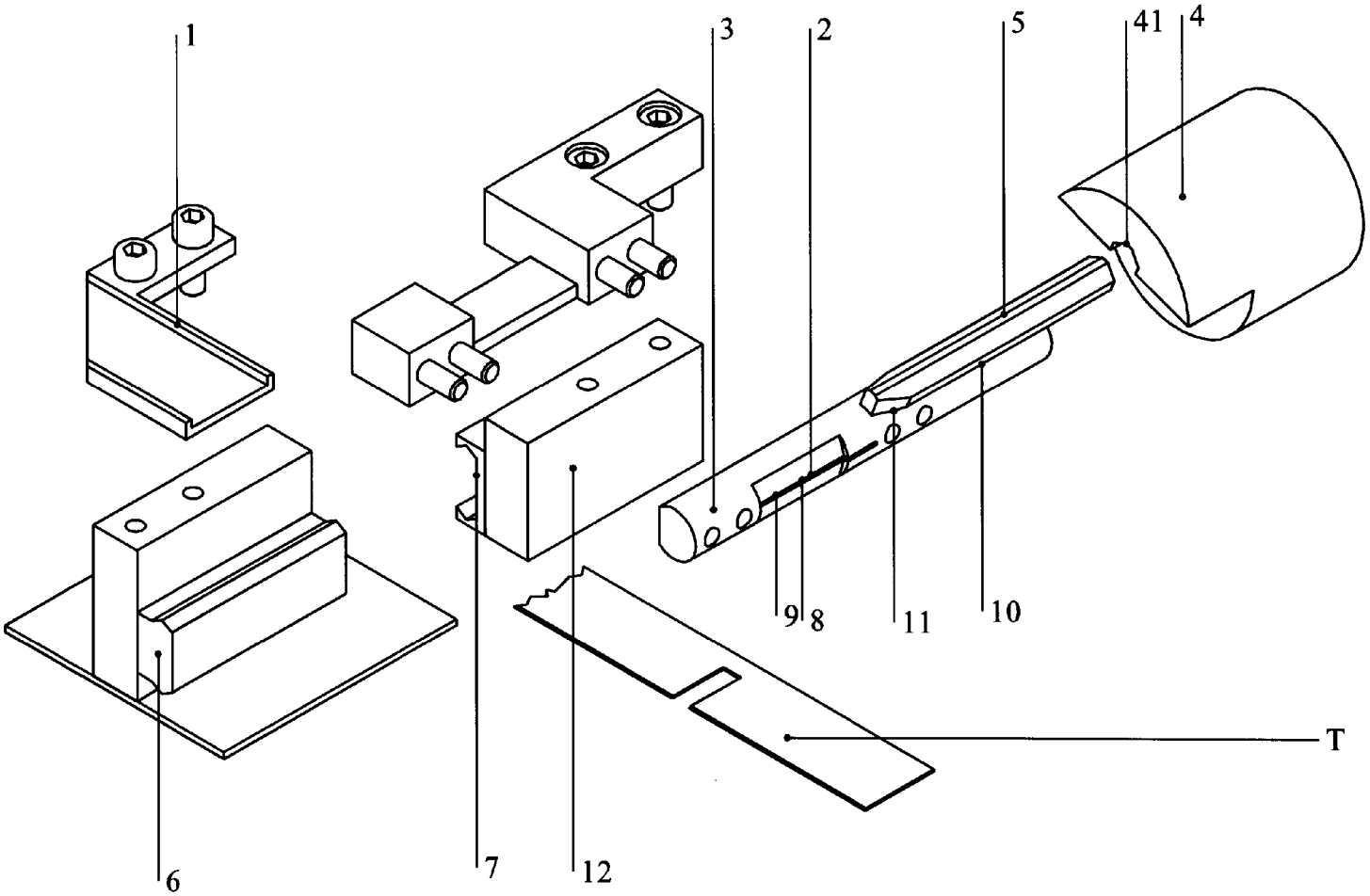
FIG. 3 shows an axonometric exploded view of the embodiment of the device of the previous Figures.
Figure 4:
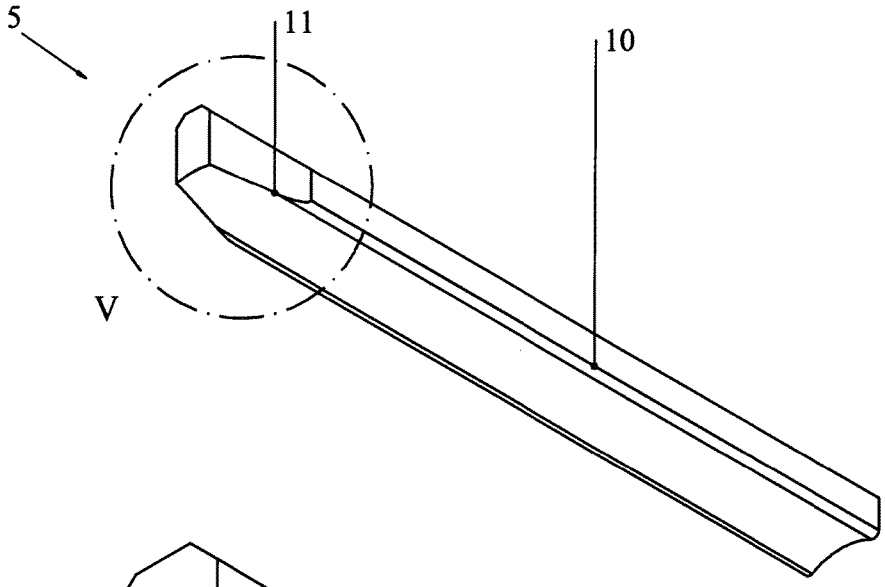
FIG. 4 shows an axonometric view of a tool for bending and cutting belonging to an embodiment of the device according to the present invention.
Figure 5:
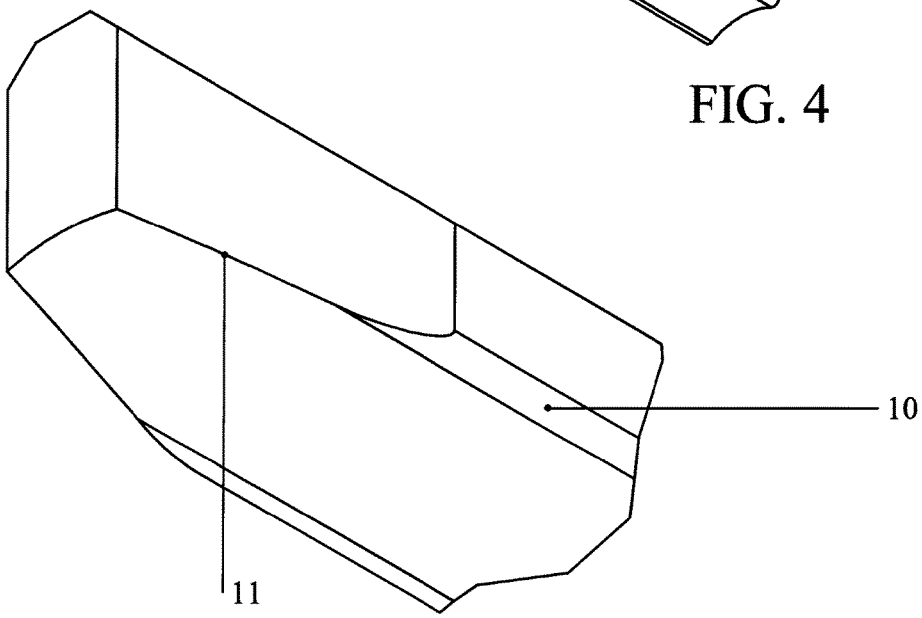
FIG. 5 shows an enlarged view of a portion of the previous Figure.
Figure 6:
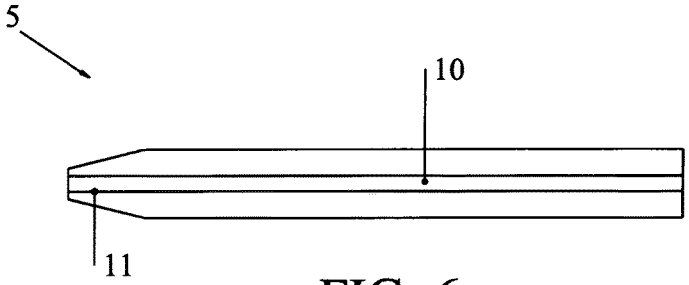
FIGS. 6 and 7 show an orthogonal projection view of a tool for bending and cutting shown in the previous Figure.
Figure 7:
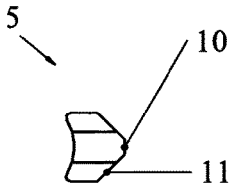
Figure 8:
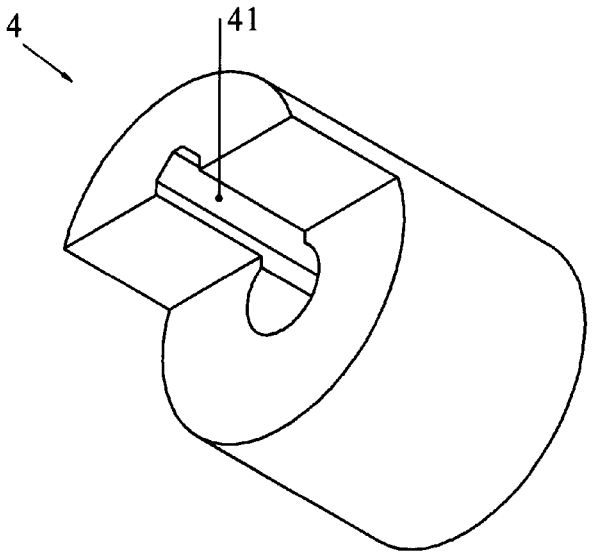
FIG. 8 shows an axonometric view of a rotary template belonging to an embodiment of the device according to the present invention.
Figure 9:
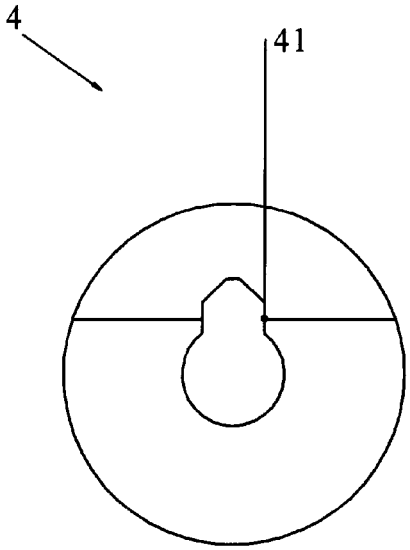
FIG. 9 shows a front view of the rotary template of the previous Figure.
Figure 10:
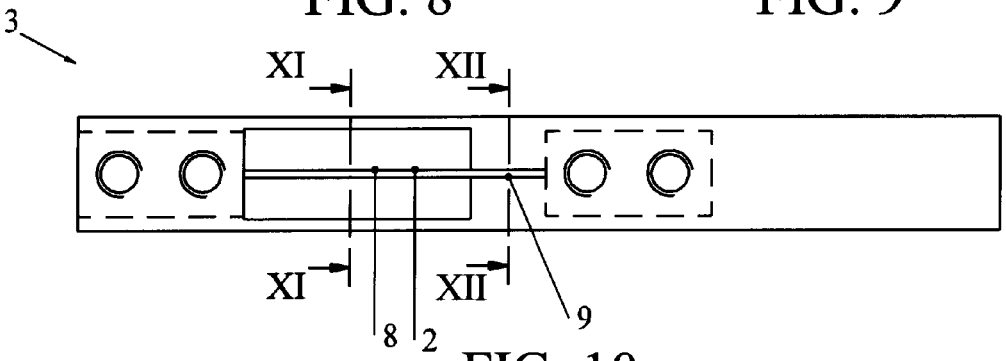
FIG. 10 shows a side view of a fixed template with portion of profile for bending and for cutting, belonging to an embodiment of the device according to the present invention.
Figure 11:
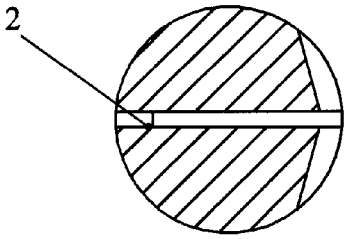
FIGS. 11 and 12 show an enlarged sectional view, respectively along line XI-XI and line XII-XII of the previous Figure.
Figure 12:
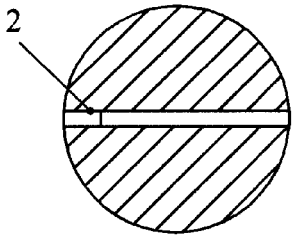
Figures 13, 14, 15, 16, 17, 18, 19:
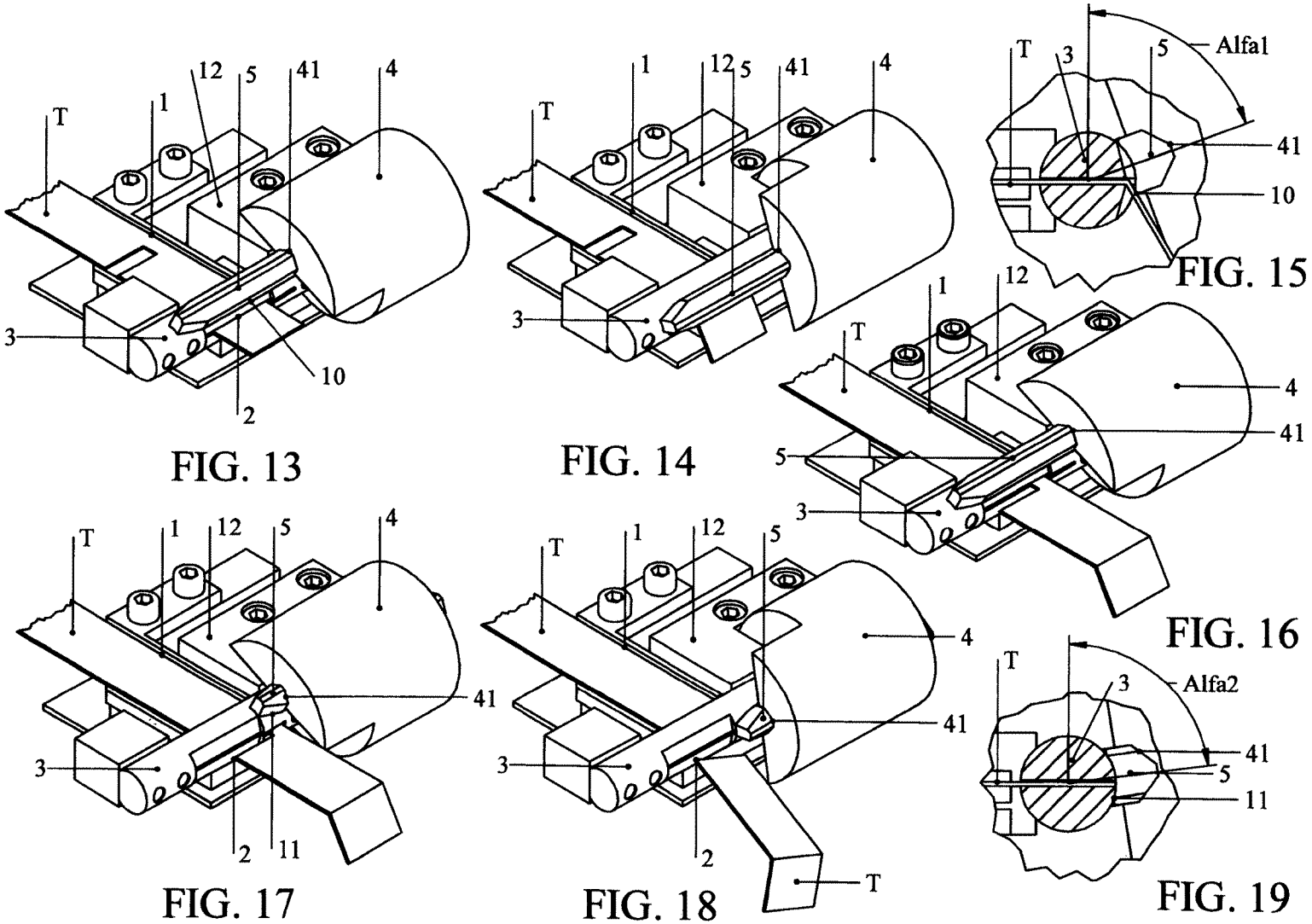
FIGS. 13, 14, 16, 17 and 18 show axonometric views of the steps for bending and cutting ribbon-shaped elements, of an embodiment of the device according to the present invention.
FIGS. 15 and 19 show partially and enlarged sectional views of the fixed template and of the tool during the bending and cutting actions, of an embodiment of the device according to the present invention.
Figure 20:
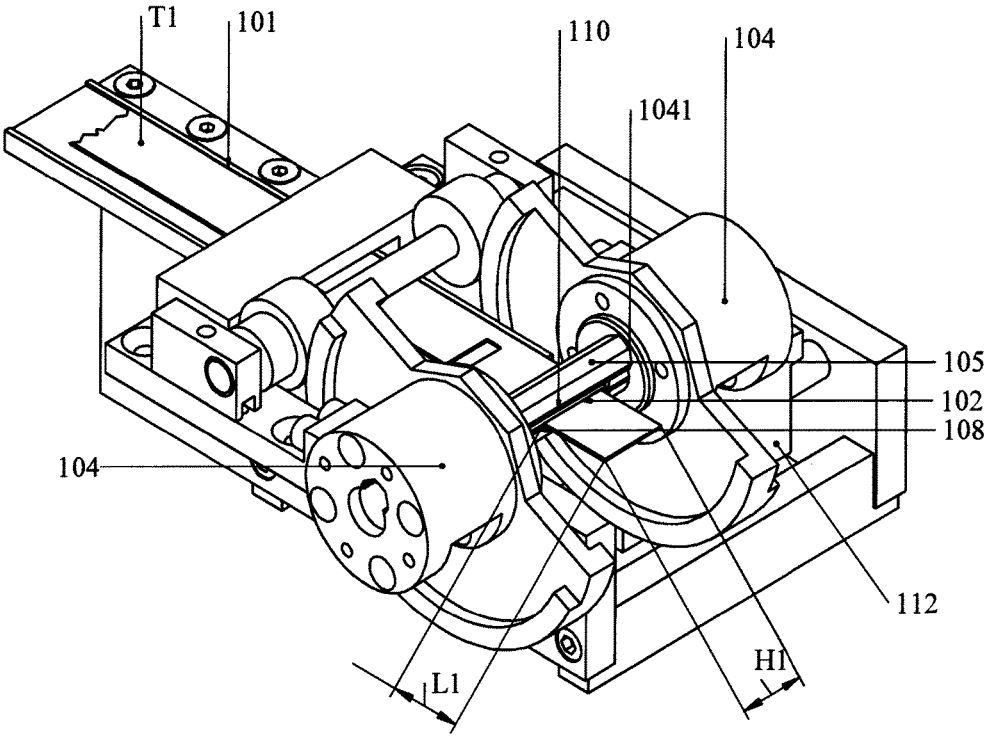
FIG. 20 shows an axonometric view of an embodiment of the device arranged for bending, in a version doubling the rotation means.
Figure 21:
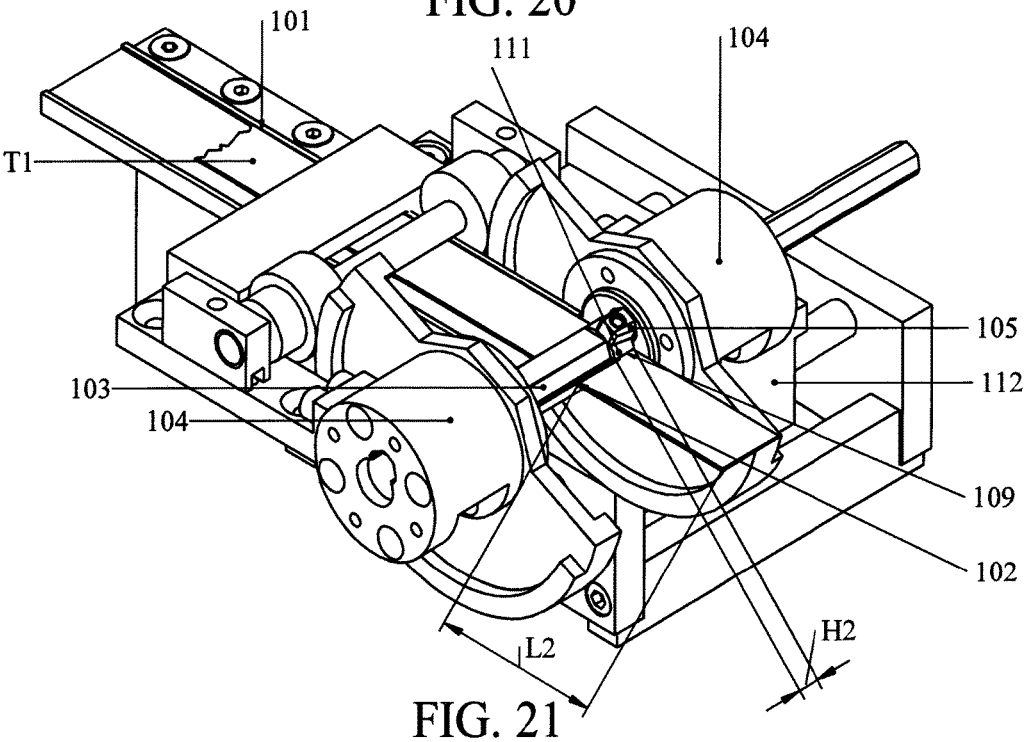
FIG. 21 shows an axonometric view of an embodiment of the device arranged for cutting, in a version doubling the rotation means according to the previous Figure.

With reference to FIGS. 1 to 12, 20, 21, it is possible to note that a combined device for bending and cutting ribbon-shaped elements comprises: first guiding and supporting means 1, 101 adapted to allow positioning at least one ribbon-shaped element T, T1; second guiding and supporting means 3, 103 adapted to prevent the rotation of the ribbon-shaped element T, T1 with respect to an axis belonging to the plane on which the ribbon-shaped element T, T1 rests; first translating means 41, 1041 and rotation means 4, 104 adapted to move at least one tool 5, 105 with respect to the second guiding and supporting means 3, 103.

Such second guiding and supporting means 3, 103 comprise at least one portion of bending profile 8, 108 adapted to bend the ribbon-shaped element T, T1 and at least one portion of cutting profile 9, 109 adapted to cut the ribbon-shaped element T, T1.

The first translating means 41, 1041 allow aligning at least one portion of bending profile 10, 110 of the tool 5, 105 with the portion of bending profile 8, 108 of the second guiding and supporting means 3, 103 and at least one portion of cutting profile 11, 111 of the tool 5, 105 with the portion of cutting profile 9, 109 of the second guiding and supporting means 3, 103.

A device according to the principles of the invention also comprises second translating means 6, 7, 12, 112 adapted to move the assembly of the second guiding and supporting means 3, 103 with the tool 5, 105 with respect to the first guiding and supporting means 1, 101.

In this way, it is possible to move the aligned portions of profile, being them for bending 8, 108 with 10, 110, and/or for cutting 9, 109 with 11, 111, belonging to the second guiding and supporting means 3, 103 and to the tool 5, 105 respectively, so that such portions of profile can operate next to certain heights on the ribbon-shaped element T, T1.

Finally, the rotation means 4, 104 impose a rotation to the tool 5, 105 and therefore, since the ribbon-shaped element T, T1 is prevented in its rotation by the second guiding and supporting means 3, 103, allow cutting or bending the ribbon-shaped element T, T1.

According to a preferred configuration, the second guiding and supporting means 3, 103 are connected to a slider 12, 112 adapted to translate along guides 6, 7 with respect to the first guiding and supporting means 1, 101. Moreover, the second guiding and supporting means 3, 103 comprise at least one slit 2, 102 adapted to be crossed by said at least one ribbon-shaped element T, T1. The slit 2, 102 comprises the portion of bending profile 8, 108 and the portion of cutting profile 9, 109 to be able to bend and cut the ribbon-shaped element T, T1.

The rotation means 4, 104 and the first translating means 41, 1041 belong to at least one rotary template equipped with a groove adapted to allow the tool 5, 105 to translate with respect to the rotary template, which can rotate with respect to an axis of the slider 12, 112.

In a first configuration of the device, the rotation means 4 allow projectingly supporting the tool 5.

If with the embodiment with projections excessive stresses are created on the tool, it is possible to use currently known solutions. For example, Japanese Patent 62-181835 deals with a bending device composed of two sections in which in each one two supports are present, which coaxially rotate in the same way, the element to be bent passes between such supports and the sliding tool of every section reaches and uses both rotary supports. Therefore, by exploiting the same technique, in a second configuration of the device shown in FIGS. 20, 21, a pair of rotation means 104 allows supporting the ends of the tool 105.

In both configurations of the device, the translation of the tool 5, 105 with respect to the rotation means 4, 104 allows mating the bending or cutting profiles of the tool 5, 105 with those obtained along the slit 2, 102 of the second guiding and supporting means 3, 103.

In particular, with the second configuration of the device, the pair of rotation means 104 is placed so that such ribbon-shaped element T1 are approximately at the center between them and such rotation means 104 are connected through transmission members in order to perform the same angular displacements.

Object of such second configuration is guaranteeing a second support to such tool 105 in order to reduce its flexure during the bending and cutting actions.

Figure 22:
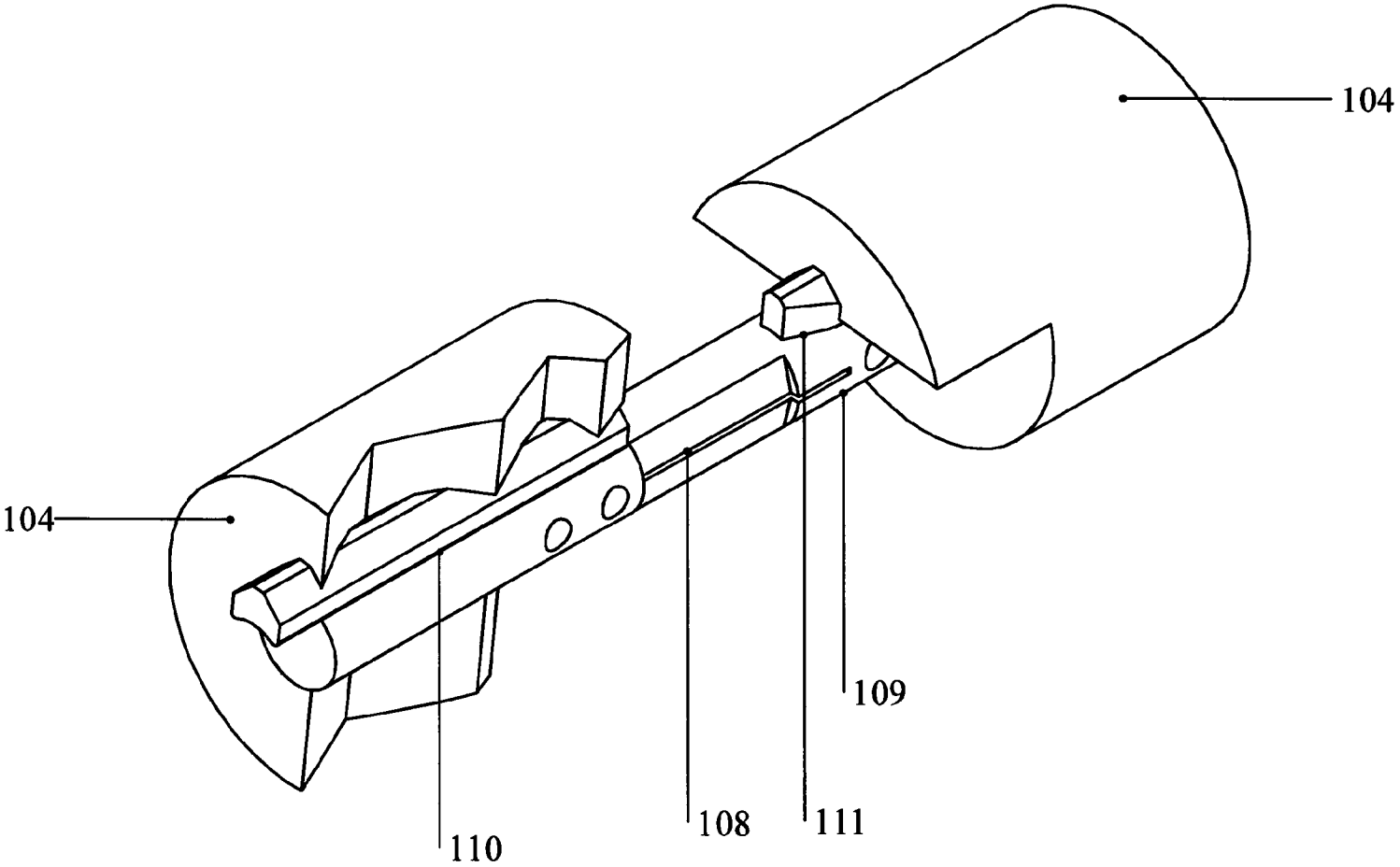
FIG. 22 shows an axonometric and partially sectioned view of some components of an embodiment of the device, in a first variation of the version of the previous Figure.

Merely as an example, FIG. 22 shows a possible version of the device in which the portions of profile for cutting and bending are associated with separate tools, two in this specific case. In the particular case, the tools slide in two rotary templates, but there could also be a single rotation element with different sliding tools. The view is limited to essential elements.

Figures 23, 24:
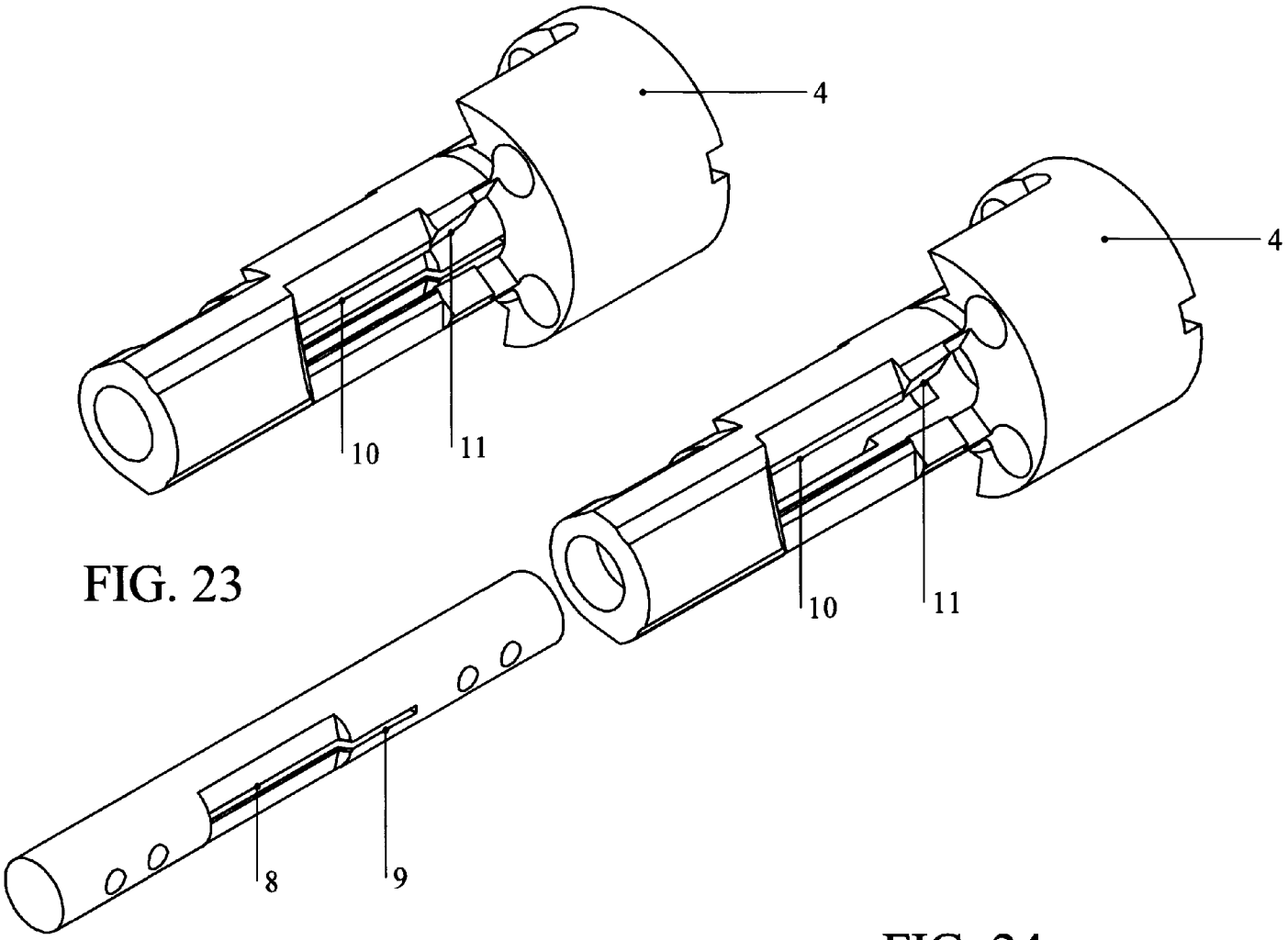
FIG. 23 shows an axonometric view of some components of an embodiment of the device, in a second variation of the version of FIG. 21.
FIG. 24 shows an exploded axonometric view of the elements of the previous Figure.

In the same way, merely as an example, FIGS. 23 and 24 show a possible version of the device in which the tool have a null sliding, namely t is fastened to the rotation means. In this way, however, there could be problems to obtain bending and cutting on both sides of the ribbon-shaped element, to solve which the fixed tool is doubled.

From the kinematic point of view, therefore, there are at least three chances of movement:

two secondary movements for arranging the bending or cutting action. Taking into account the meaningful elements, this is the sliding movement of the tool 5, 105 with respect to the second guiding and supporting means 3, 103 and of the movement of the assembly of the tool 5, 105 with the second guiding and supporting means 3, 103 with respect to the ribbon-shaped element T, T1; in case of a non-sliding tool 5, 105, only the second movement is possible;

a main movement, namely the rotation movement of such tool 5, 105 around the second guiding and supporting means 3, 103; such main movement performs the bending or cutting action.

Since the main movement is the one that usually needs most power, it is also the most encumbrant and costly one. Therefore, the structure of the invention composed as such, allowing to use a single movement member for both bending and cutting actions, is economic and compact.

With reference to FIGS. 13 to 19, a method for bending ribbon-shaped elements by means of an embodiment of such device comprises the following steps:

a—rotating the rotation means 4, 104 by a suitable angle Alfa0 to allow the sliding of the ribbon-shaped element T, T1 routed by the first guiding and supporting means 1, 101, through and over the slit 2, 102 of the second guiding and supporting means 3, 103;

b—translating the ribbon-shaped element T, T1 by an amount L1, corresponding to a bending position of the ribbon-shaped element T, T1;

c—translating the tool 5, 105 through the first translating means 41, 1041, in order to align the portion of bending profile 10, 110 of the tool 5, 105 with the portion of bending profile 8, 108 of the slit 2, 102;

d—translating the assembly of the second guiding and supporting means 3, 103 with the tool 5, 105 with respect to the first guiding and supporting means 1, 101, by an amount H1, corresponding to a bending height of the ribbon-shaped element T, T1;

e—rotating the rotation means 4, 104 by a suitable angle Alfa1 to be able to bend the ribbon-shaped element T, T1;

f—repeating step a;

g—translating the ribbon-shaped element T, T1 by an amount L2, corresponding to a cutting position of the ribbon-shaped element T, T1;

h—translating the tool 5, 105 through the first sliding means 41, 1041, in order to align the portion of cutting profile 11, 111 of the tool 5, 105 with the portion of cutting profile 9, 109 of the slit 2, 102;

i—translating the assembly of the second guiding and supporting means 3, 103 with the tool 5, 105 with respect to the first guiding and supporting means 1, 101, by an amount H2, corresponding to a cutting height of the ribbon-shaped element T, T1;

l—rotating the rotation means 4, 104 by a suitable angle Alfa2 to be able to cut the ribbon-shaped element T, T1.

With respect to handling of the two embodiments of the invention, there are elements related to position detection, such as proximities or encoders or limit switches (not shown). There are also suitable electric or electronic elements for driving the motors and interacting towards the users (not shown). It is provided to use suitable control algorithms.

The invention claimed is:

1. A combined device for bending and cutting ribbon-shaped elements, comprising a cutting tool, a first guide and support arranged to receive and allow positioning of a ribbon-shaped element, a second guide and support arranged to receive and prevent rotation of the ribbon-shaped element with respect to an axis of a plane on which the ribbon-shaped element rests, and a first translator and a rotator coupled together and arranged to receive and move the tool with respect to the second guide and support, wherein the second guide and support has a bending profile positioned to bend the ribbon-shaped element and a cutting profile positioned to cut the ribbon-shaped element.

2. The combined device of claim 1, wherein the tool has a bending profile and a cutting profile, and the first translator is arranged to allow aligning of the bending profile of the tool with the bending profile of the second guide and support to bend the ribbon-shaped element, and the cutting profile of the tool with the cutting profile of the second guide and support to cut the ribbon-shaped element.

3. The combined device of claim 2, further comprising a second translator positioned to move, with respect to the first guide and support, an assembly composed of the second guide and support and the tool.

4. The combined device of claim 3, wherein the second guide and support has a slit positioned to be crossed by the ribbon-shaped element, the slit comprising the bending profile of the second guide and support to bend the ribbon-shaped element and the cutting profile of the second guide and support to cut the ribbon-shaped element.

5. The combined device of claim 4, wherein the first translator is equipped with a groove, the groove receiving the tool to allow the tool to translate with respect to the first translator and rotator, and the first translator and rotator positioned to rotate with respect to an axis of the second translator.

6. The combined device of claim 5, comprising an additional rotator, with the pair of rotators positioned to support ends of the tool to symmetrically divide the bending and cutting loads.

7. The combined device of claim 1, wherein the rotator projectingly supports the tool.

8. A method for bending and cutting ribbon-shaped elements with the device according to claim 1, the method comprising the following steps:

a—rotating the rotator by a suitable angle to allow sliding of the ribbon-shaped element routed by the first guide and support, through and over a slit of the second guide and support, wherein the slit comprises the bending profile of the second guide and support and the cutting profile of the second guide and support b—translating the ribbon-shaped element by an amount corresponding to a bending position of the ribbon-shaped element;

c—translating the tool through the first translator, to align a bending profile of the tool with the bending profile of the slit;

d—translating the second guide and support with the tool with respect to the first guide and support by an amount corresponding to a bending height of the ribbon-shaped element;

e—rotating the rotator by a suitable angle to bend the ribbon-shaped element;

f—repeating step a;

g—translating the ribbon-shaped element by an amount corresponding to a cutting position of the ribbon-shaped element;

h—translating the tool to align a cutting profile of the tool with the cutting profile of the slit;

i—translating the second guide and support with the tool with respect to the first guide and support by an amount corresponding to a cutting height of the ribbon-shaped element; and j—rotating the rotator by a suitable angle to cut the ribbon-shaped element.

* * * * *